US005735065A

United States Patent [19]

Yamagata et al.

[11] Patent Number: 5,735,065

[45] Date of Patent: Apr. 7, 1998

[54] AREA LIMITING EXCAVATION CONTROL SYSTEM FOR CONSTRUCTION MACHINE

[75] Inventors: Eiji Yamagata, Tsuchiura; Kazuo Fujishima, Ibaraki-ken; Hiroyuki Adachi, Tsuchiura; Hiroshi Watanabe, Ushiku; Masakazu Haga, Ibaraki-ken, all of Japan

[73] Assignee: Hitachi Construction Machinery Co., Ltd., Tokyo, Japan

[21] Appl. No.: 658,545

[22] Filed: Jun. 5, 1996

[30] Foreign Application Priority Data

Jun. 9, 1995 [JP] Japan ..... 7-142985

[51] Int. Cl.[6] ..... E02F 5/02

[52] U.S. Cl. ..... 37/348; 701/50; 414/699

[58] Field of Search ..... 37/348, 414, 382; 172/2–5; 364/424.07; 414/694, 699; 701/50

[56] References Cited

U.S. PATENT DOCUMENTS

| | | | |
|---|---|---|---|
| 5,178,510 | 1/1993 | Hanamoto et al. | 37/348 X |
| 5,446,980 | 9/1995 | Rocke | 364/424.07 X |
| 5,479,729 | 1/1996 | Eslambolchi | 37/348 X |
| 5,488,787 | 2/1996 | Aoyagi et al. | 37/348 |
| 5,490,081 | 2/1996 | Kuromoto et al. | 364/424.07 X |
| 5,535,532 | 7/1996 | Fujii et al. | 37/348 |

FOREIGN PATENT DOCUMENTS

| | | |
|---|---|---|
| 0 707 118 | 4/1996 | European Pat. Off. . |
| 0 711 876 | 5/1996 | European Pat. Off. . |
| 4-011128 | 4/1992 | Japan . |
| 4-136324 | 5/1992 | Japan . |
| 5-079063 | 7/1993 | Japan . |
| 2 272 204 | 5/1994 | United Kingdom . |
| 2 275 462 | 8/1994 | United Kingdom . |

*Primary Examiner*—Terry Lee Melius
*Assistant Examiner*—Victor Batson
*Attorney, Agent, or Firm*—Fay,Sharpe,Beall, Fagan,Minnich & McKee

[57] ABSTRACT

In an area limiting excavation control system for construction machines such as hydraulic excavators, excavation is smoothly and efficiently carried out within a limited area by setting an area beforehand where a front attachment (1A) is movable, calculating the position and posture of the front-attachment (1A) by a control unit (9) based on signals from angle sensors (8*a*) to (8*c*), calculating a limit value of the component of the boom-dependent bucket tip speed vertical to the boundary of the set area so that when the front attachment is inside the set area near the boundary thereof, the moving speed of the front attachment in the direction vertical to the boundary of the set area is restricted, and when the front attachment is outside the set area, it is returned to the set area, and modifying a boom operation signal so as to prevent the boom-dependent bucket tip speed from exceeding the limit value.

24 Claims, 10 Drawing Sheets a : BUCKET TIP SPEED LIMIT VALUE
b : ARM-DEPENDENT BUCKET TIP SPEED
c : BOOM-DEPENDENT BUCKET TIP SPEED LIMIT VALUE
$b_x$ : COMPONENT OF ARM-DEPENDENT BUCKET TIP SPEED PARALLEL TO BOUNDARY
$b_y$ : COMPONENT OF ARM-DEPENDENT BUCKET TIP SPEED VERTICAL TO BOUNDARY
D : DISTANCE FROM BOUNDARY TO BUCKET TIP

AREA LIMITING EXCAVATION CONTROL SYSTEM FOR CONSTRUCTION MACHINE

BACKGROUND OF THE INVENTION

The present invention relates to an area limiting excavation control system for a construction machine including a multi-articulated front attachment, and more particularly to an area limiting excavation control system which is mounted on a hydraulic excavator including a front attachment comprised of front elements such as an arm, a boom and a bucket, and which can perform excavation while limiting an area where the front attachment is movable.

In a hydraulic excavator, front elements such as a boom are operated by an operator using respective manual control levers. However, because the front elements are coupled to each other in an articulated manner for pivotal motion, it is very difficult to excavate just a predetermined area by operating the front elements. In view of the above, an area limiting excavation control system is proposed in JP, A, 4-136324, aiming to facilitate such excavation work. This proposed area limiting excavation control system comprises means for detecting the posture of a front attachment, means for calculating the position of the front attachment based on a signal from the detecting means, means for teaching an entrance forbidden area where the front attachment is prohibited from entering, lever gain calculating means for determining the distance d between the position of the front attachment and the boundary line of the taught entrance forbidden area and for outputting the product of a lever control signal multiplied by a function which depends on the distance d such that it takes a value 1 when the distance d is greater than a certain value and a value between 0 and 1 when the distance d is smaller than the certain value, and actuator control means for controlling the motion of an actuator based on a signal from the lever gain calculating means. With the proposed system, since the lever control signal is restricted depending on the distance to the boundary line of the entrance forbidden area, even when the operator is going to move the tip of a bucket into the entrance forbidden area by mistake, the bucket tip is smoothly stopped at the boundary automatically, or the operator can return the bucket tip by noticing the approach of the bucket tip to the entrance forbidden area on the way toward the boundary line, judging from a reduction in the speed of the front attachment.

SUMMARY OF THE INVENTION

However, the above-mentioned prior art has problems as follows.

With the prior art disclosed in JP, A, 4-136324, since the lever gain calculating means outputs, to the actuator control means, the product of the lever control signal multiplied by the function simply depending on the distance d, the bucket tip is gradually sped down as it approaches the boundary of the entrance forbidden area, and is finally stopped at the boundary of the entrance forbidden area. Therefore, a shock that would otherwise be generated upon the bucket tip going to enter the entrance forbidden area can be avoided. But this prior art is designed to speed down the bucket tip such that the speed is always reduced regardless of the direction in which the bucket tip is moving. Accordingly, when the excavation is to be performed along the boundary of the entrance forbidden area, the digging speed in the direction along the boundary of the entrance forbidden area is also reduced as the bucket tip approaches the entrance forbidden area with operation of the arm. This requires the operator to manipulate a boom lever to move the bucket tip away from the entrance forbidden area each time the digging speed is reduced, in order to prevent a drop of the digging speed. As a result, the working efficiency is extremely deteriorated when excavation is to be performed along the boundary of the entrance forbidden area.

An object of the present invention is to provide an area limiting excavation control system for a construction machine which can smoothly and efficiently perform excavation within a limited area.

To achieve the above object, the present invention is constituted as follows.

(1) According to the present invention, in an area limiting excavation control system for a construction machine comprising:

a multi-articulated front attachment constituted by a plurality of front elements coupled to each other in a relatively rotatable manner;

a plurality of hydraulic actuators for driving the plurality of front elements;

a plurality of input means for instructing motions of the plurality of front elements; and a plurality of hydraulic control valves driven upon operation of the plurality of input means for controlling respective flow rates of a hydraulic fluid supplied to the plurality of hydraulic actuators, wherein the control system further comprises:

area setting means for setting an area where the front attachment is movable;

first detecting means for detecting status variables with regard to the position and posture of the front attachment;

first calculating means for calculating the position and posture of the front attachment based on signals from the first detecting means;

second calculating means for calculating the speed of the front attachment which depends on driving of at least a first particular actuator associated with a first particular front element among the plurality of hydraulic actuators;

third calculating means for calculating, based on the values calculated by the first and second calculating means, a limit value of the speed of the front attachment which depends on driving of at least a second particular actuator associated with a second particular front element among the plurality of hydraulic actuators so that when the front attachment is inside the set area near the boundary thereof, the moving speed of the front attachment in the direction toward the boundary of the set area is restricted; and signal modifying means for modifying an operation signal from the input means associated with the second particular actuator so that the speed of the front attachment which depends on driving of the second particular actuator will not exceed the limit value.

In the present invention constituted as set forth above, when the front attachment is inside the set area near the boundary thereof, the third calculating means calculates a limit value of the speed of the front attachment which depends on driving of the second particular actuator associated with the second particular front element, and the signal modifying means modifies an operation signal from the input means associated with the second particular actuator so that the speed of the front attachment which depends on driving of the second particular actuator will not exceed the limit value. Therefore, direction change control is carried out in such a manner as to speed down the motion of the front attachment in the direction toward the boundary of the set area. Thus the front attachment can be moved along the boundary of the set area. It is hence possible to smoothly and efficiently perform the excavation within the set area.

(2) In the above (1), preferably, the second calculating means is means for calculating the speed of the front attachment which depends on driving of the first particular actuator, based on an operation signal from the input means associated with the first particular front element among the plurality of input means.

(3) In the above (1), the second calculating means may be means for calculating the speed of the front attachment which depends on driving of the first particular actuator, based on a signal from the first detecting means.

(4) In the above (2) or (3), preferably, the third calculating means calculates a limit value of the speed of the front attachment which depends on driving of at least the second particular actuator associated with the second particular front element among the plurality of hydraulic actuators so that when the front attachment is outside the set area, it is returned to the set area.

When the front attachment is subjected to the direction change control near the boundary of the set area as stated in the above (1), the bucket tip may go out beyond the boundary of the set area due to a delay in control response and the inertia of the front attachment if the motion of the front attachment is so fast. In such a case, the third calculating means calculates a limit value of the speed of the front attachment which depends on driving of at least the second particular actuator associated with the second particular front element among the plurality of hydraulic actuators so that when the front attachment is outside the set area, it is returned to the set area. Thus, the front attachment is controlled to quickly move back to the set area after entering the forbidden area. Accordingly, even if the front attachment is moved fast, it can be moved along the boundary of the set area for precise excavation within a limited area.

In this connection, since the front attachment is sped down beforehand with the direction change control as stated in the above (1), the amount by which the front attachment goes out beyond the set area is reduced and a shock which would otherwise be produced upon returning to the set area is much abated. Accordingly, even if the front attachment is moved fast, it can be smoothly moved along the boundary of the set area for smooth excavation within a limited area.

(5) In the above (4), preferably, the third calculating means includes means for calculating a limit value of the speed of the front attachment based on the distance between the front attachment and the boundary of the set area, the distance being determined from the values calculated by the first calculating means; and means for calculating a limit value of the speed of the front attachment which depends on driving of the second particular actuator, based on the value calculated by the second calculating means and the limit value of the speed of the front attachment.

(6) In the above (5), preferably, a distance versus speed relationship is preset such that when the front attachment is inside the set area, the limit value is given as a speed in the direction approaching the boundary of the set area which speed is reduced as the distance between the front attachment and the boundary of the set area reduces, and when the front attachment is outside the set area, the limit value is given as a speed in the direction returning to the boundary of the set area which speed is increased as the distance increases, and the above means for calculating a limit value of the speed of the front attachment calculates the limit value of the speed of the front attachment based on the distance between the front attachment and the boundary of the set area, the distance being determined from the values calculated by the first calculating means, and the preset relationship.

(7) In the above (5) or (6), preferably, the signal modifying means includes means for calculating a limit value of the operation signal of the input means associated with the second particular front element, corresponding to the limit value of the speed of the front attachment which depends on driving of the second particular actuator; and means for selecting smaller one of a command value of the operation signal from the input means associated with the second particular front element and the limit value of the operation signal.

(8) In the above (5) or (6), at least the input means associated with the second particular front element among the plurality of input means may be of hydraulic pilot type outputting a pilot pressure as the operation signal, and an operation system including the input means of hydraulic pilot type may drive corresponding one of the hydraulic control valves. In this case, the signal modifying means is pilot pressure modifying means for modifying the pilot pressure from the input means associated with the second particular actuator so that the speed of the front attachment which depends on driving of the second particular actuator will not exceed the limit value.

(9) In the above (8), preferably, the operation system includes a first pilot line for introducing a pilot pressure to the hydraulic control valve associated with the second particular front element so that the front attachment moves in the direction away from the boundary of the set area, and the pilot pressure modifying means comprises means for calculating a target pilot pressure in the first pilot line so that the speed of the front attachment which depends on driving of the second particular actuator will not exceed the limit value, and outputting a first electric signal corresponding to the target pilot pressure;

electro-hydraulic converting means for converting the first electric signal into a hydraulic pressure and outputting a control pressure corresponding to the target pilot pressure; and higher pressure selecting means for selecting higher one of the pilot pressure in the first pilot line and the control pressure output from the electro-hydraulic converting means, and introducing the selected pressure to the corresponding hydraulic control valve.

(10) In the above (8), preferably, the operation system includes a second pilot line for introducing a pilot pressure to the hydraulic control valve associated with the second particular front element so that the front attachment moves in the direction toward the boundary of the set area, and the pilot pressure modifying means comprises means for calculating a target pilot pressure in the second pilot line so that the speed of the front attachment which depends on driving of the second particular actuator will not exceed the limit value, and outputting a second electric signal corresponding to the target pilot pressure; and pressure reducing means disposed in the second pilot line and operated by the second electric signal for reducing the pilot pressure in the second pilot line down to the target pilot pressure.

(11) In the above (1) to (10), the plurality of front elements may include a boom and an arm of a hydraulic excavator. In this case, the first particular front element is the arm and the second particular front element is the boom.

DETAILED DESCRIPTION OF THE PREFERRED EMBODIMENTS

Preferred embodiments in which the present invention is applied to a hydraulic excavator will be described with reference to the drawings.

At the outset, a first embodiment of the present invention will be explained with reference to FIGS. 1 to 6.

Figure 1:
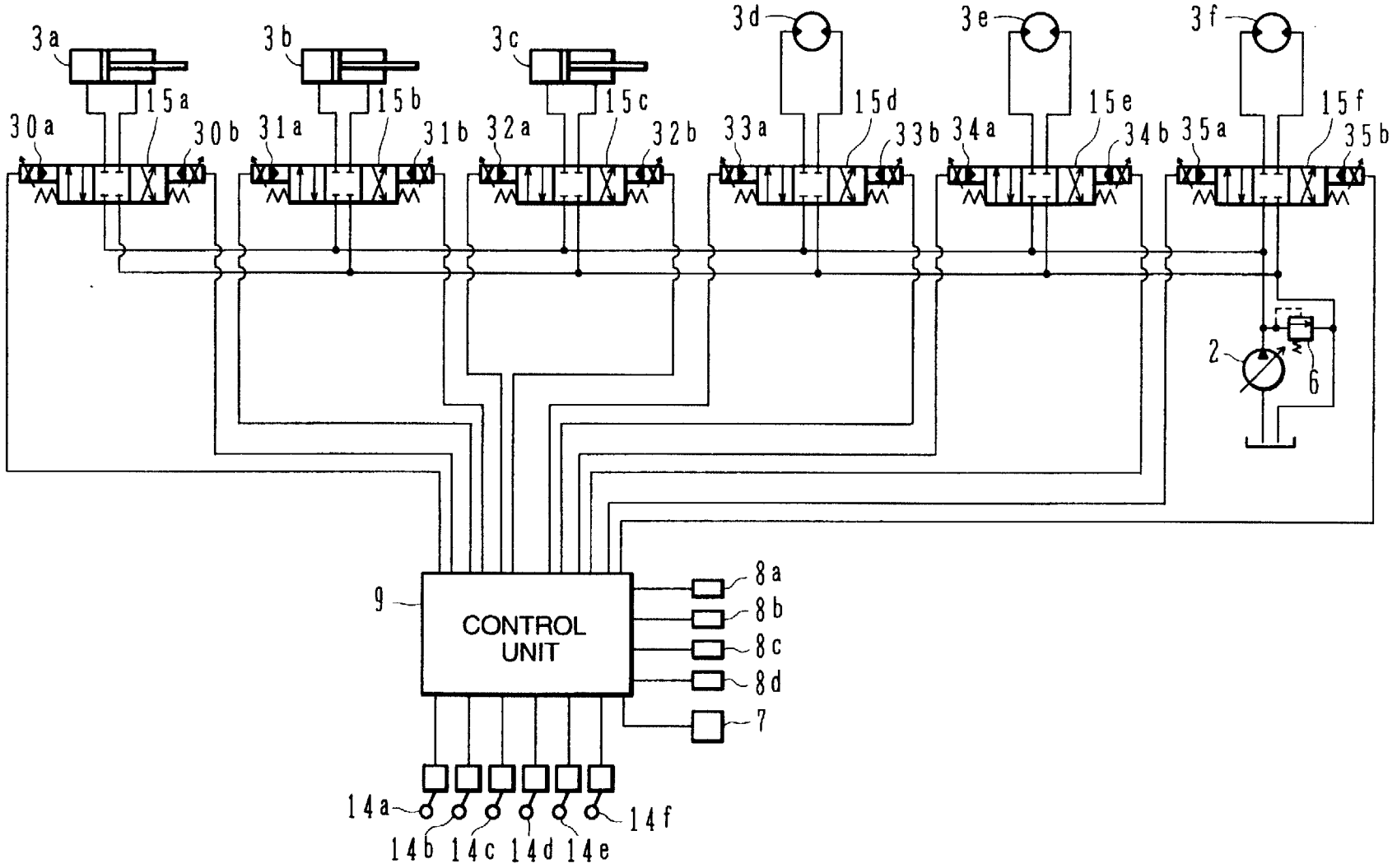
FIG. 1 is a diagram showing an area limiting excavation control system for a construction machine according to a first embodiment of the present invention, along with a hydraulic drive system.

In FIG. 1, a hydraulic excavator to which the present invention is applied comprises a hydraulic pump 2, a plurality of hydraulic actuators driven by a hydraulic fluid from the hydraulic pump 2, including a boom cylinder 3*a*, an arm cylinder 3*b*, a bucket cylinder 3*c*, a swing motor 3*d* and left and right track motors 3*e*, 3*f*, a plurality of control lever units 14*a* to 14*f* provided respectively corresponding to the hydraulic actuators 3*a* to 3*f*, a plurality of flow control valves 15*a* to 15*f* connected respectively between the hydraulic pump 2 and the plurality of hydraulic actuators 3*a* to 3*f* and controlled in accordance with respective operation signals input from the control lever units 14*a* to 14*f* for controlling respective flow rates of the hydraulic fluid supplied to the hydraulic actuators 3*a* to 3*f*, and a relief valve 6 which is opened when the pressure between the hydraulic pump 2 and the flow control valves 15*a* to 15*f* exceeds a preset value. The above components cooperatively make up a hydraulic drive system for driving driven elements of the hydraulic excavator.

Figure 2:
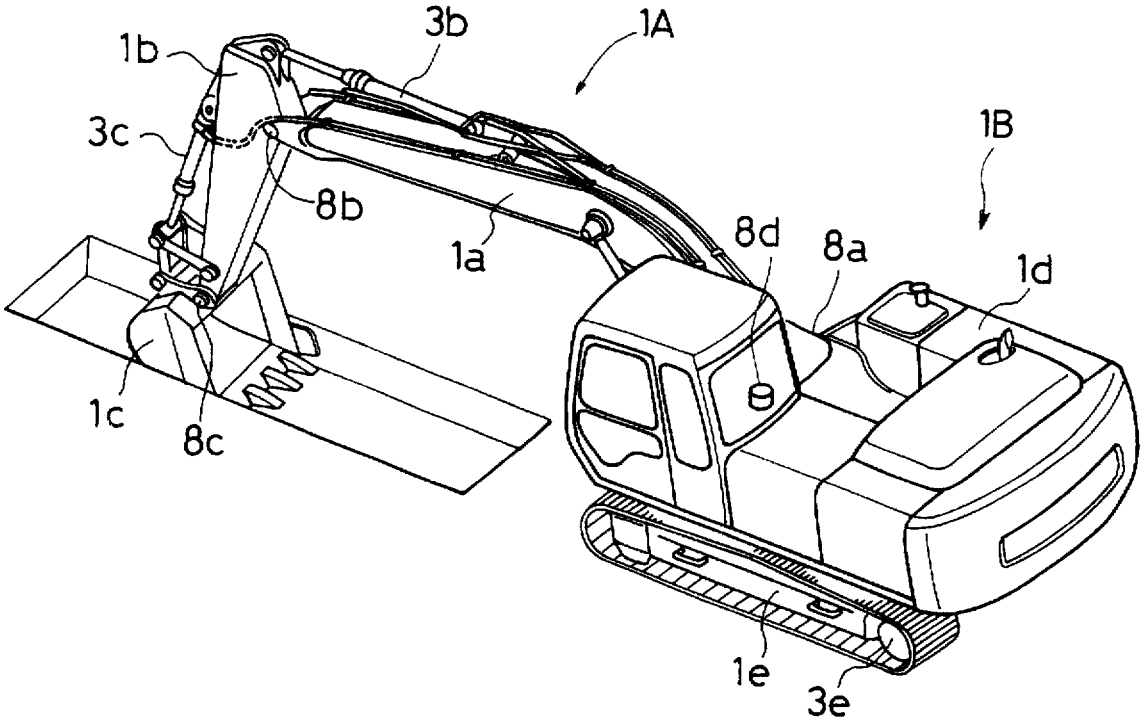
FIG. 2 is a view showing an appearance of a hydraulic excavator to which the present invention is applied.

As shown in FIG. 2, the hydraulic excavator is made up of a multi-articulated front attachment 1A comprising a boom 1*a*, an arm 1*b* and a bucket 1*c* which are coupled to each other in a relatively rotatable manner in the vertical direction, and a body 1B comprising an upper structure 1*d* and an undercarriage 1*e*. The boom 1*a* of the front attachment 1A has its base end supported to a front portion of the upper structure 1*d*. The boom 1*a*, the arm 1*b*, the bucket 1*c*, the upper structure 1*d* and the undercarriage 1*e* constitute driven elements which are driven respectively by the boom cylinder 3*a*, the arm cylinder 3*b*, the bucket cylinder 3*c*, the swing motor 3*d* and the left and right track motors 3*e*, 3*f*. These driven elements are operated in accordance with instructions from the control lever units 14*a* to 14*f*.

The control lever units 14*a* to 14*f* are each of electric lever type outputting an electric signal (voltage) as an operation signal. The flow control valves 15*a* to 15*f* are provided at their both ends with solenoid driving sectors 30*a*, 30*b*–35*a*, 35*b* having electro-hydraulic converting means, e.g., proportional solenoid valves. The control lever units 14*a* to 14*f* supply voltages depending on the amounts and directions of the inputs entered by the operator, as electric signals, to the solenoid driving sectors 30*a*, 30*b*–35*a*, 35*b* of the corresponding flow control valves 15*a* to 15*f*.

An area limiting excavation control system of this embodiment is mounted on the hydraulic excavator constructed as explained above. The control system comprises a setter 7 for providing an instruction to set an excavation area beforehand where a predetermined location of the front attachment, e.g., the tip of the bucket 1*c*, is movable, depending on the scheduled work, angle sensors 8*a*, 8*b*, 8*c* disposed respectively at pivotal points of the boom 1*a*, the arm 1*b* and the bucket 1*c* for detecting respective rotational angles thereof as status variables with regard to the position and posture of the front attachment 1A, an inclination angle sensor 8*d* for detecting an inclination angle of the body 1B in the forth-and-back direction, and a control unit 9 for receiving operation signals input from the control lever units 14*a* to 14*f*, a set signal from the setter 7 and detection signals from the angle sensors 8*a*, 8*b*, 8*c* and the inclination angle sensor 8*d*, setting the excavation area where the tip of the bucket 1*c* is movable, and modifying the input operation signals so as to perform control for excavation Within the limited area.

The setter 7 comprises input means, such as a switch, disposed on a control panel or grip for outputting a set signal to the control unit 9 to instruct setting of the excavation area. Other suitable aid means such as a display may also be provided on the control panel.

Figure 3:
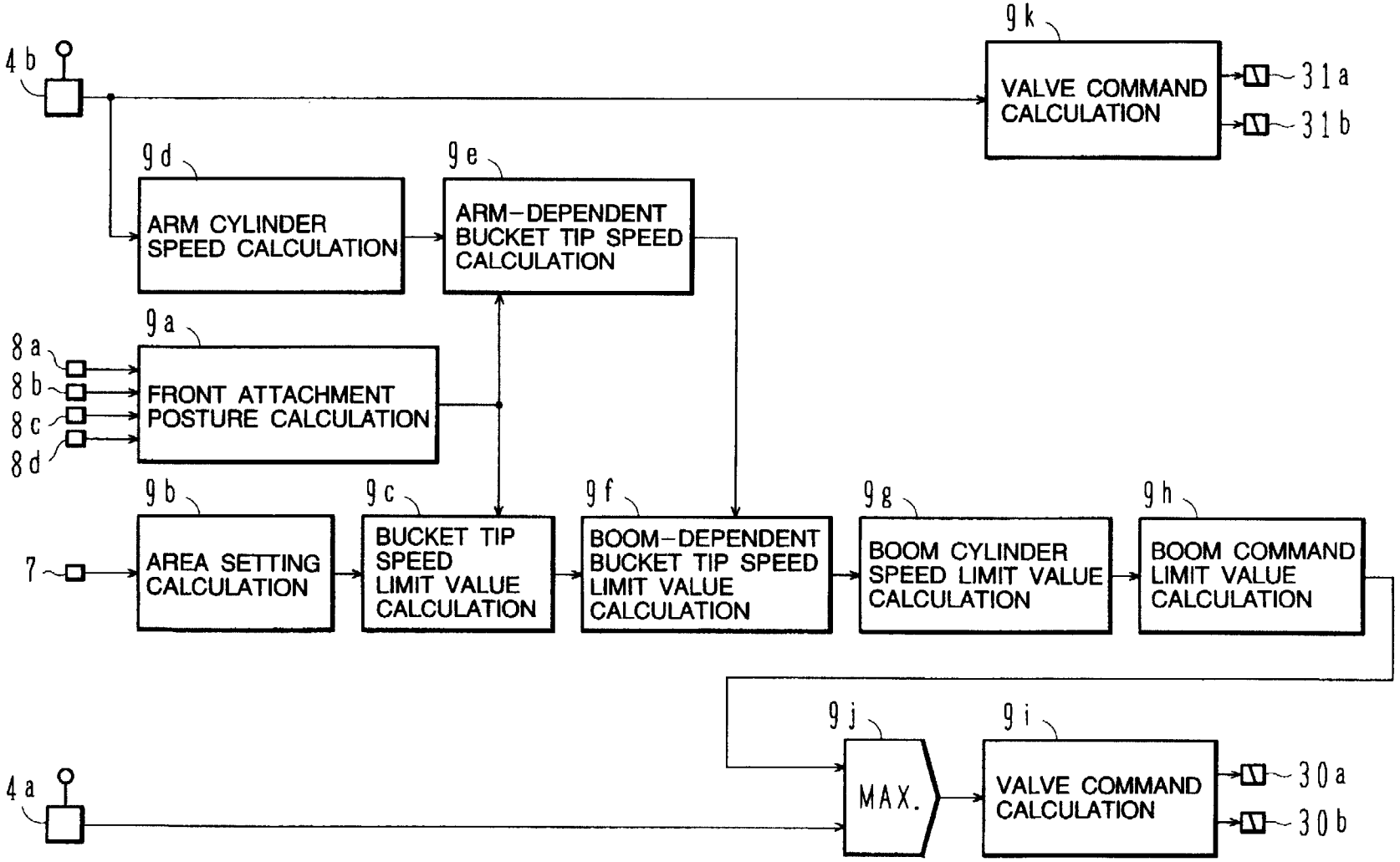
FIG. 3 is a functional block diagram showing control functions of a control unit.

Control functions of the control unit 9 are shown in FIG. 3. The control unit 9 includes functional portions of a front attachment posture calculator 9*a*, an area setting calculator 9*b*, a bucket tip speed limit value calculator 9*c*, an arm cylinder speed calculator 9*d*, an arm-dependent bucket tip speed calculator 9*e*, a boom-dependent bucket tip speed limit value calculator 9*f*, a boom cylinder speed limit value calculator 9*g*, a boom command limit value calculator 9*h*, a boom command maximum value calculator 9*j*, a boom-associated valve command calculator 9*i*, and an arm-associated valve command calculator 9*k*.

The front attachment posture calculator 9*a* calculates the position and posture of the front attachment 1A based on the rotational angles of the boom, the arm and the bucket detected by the angle sensors 8a to 8c, as well as the inclination angle of the body 1B in the forth-and-back direction detected by the inclination angle sensor 8d.

The area setting calculator 9b executes calculation for setting of the excavation area where the tip of the bucket 1c is movable, in accordance with an instruction from the setter 7. One example of a manner of setting the excavation area will be described with reference to FIG. 4.

Figure 4:
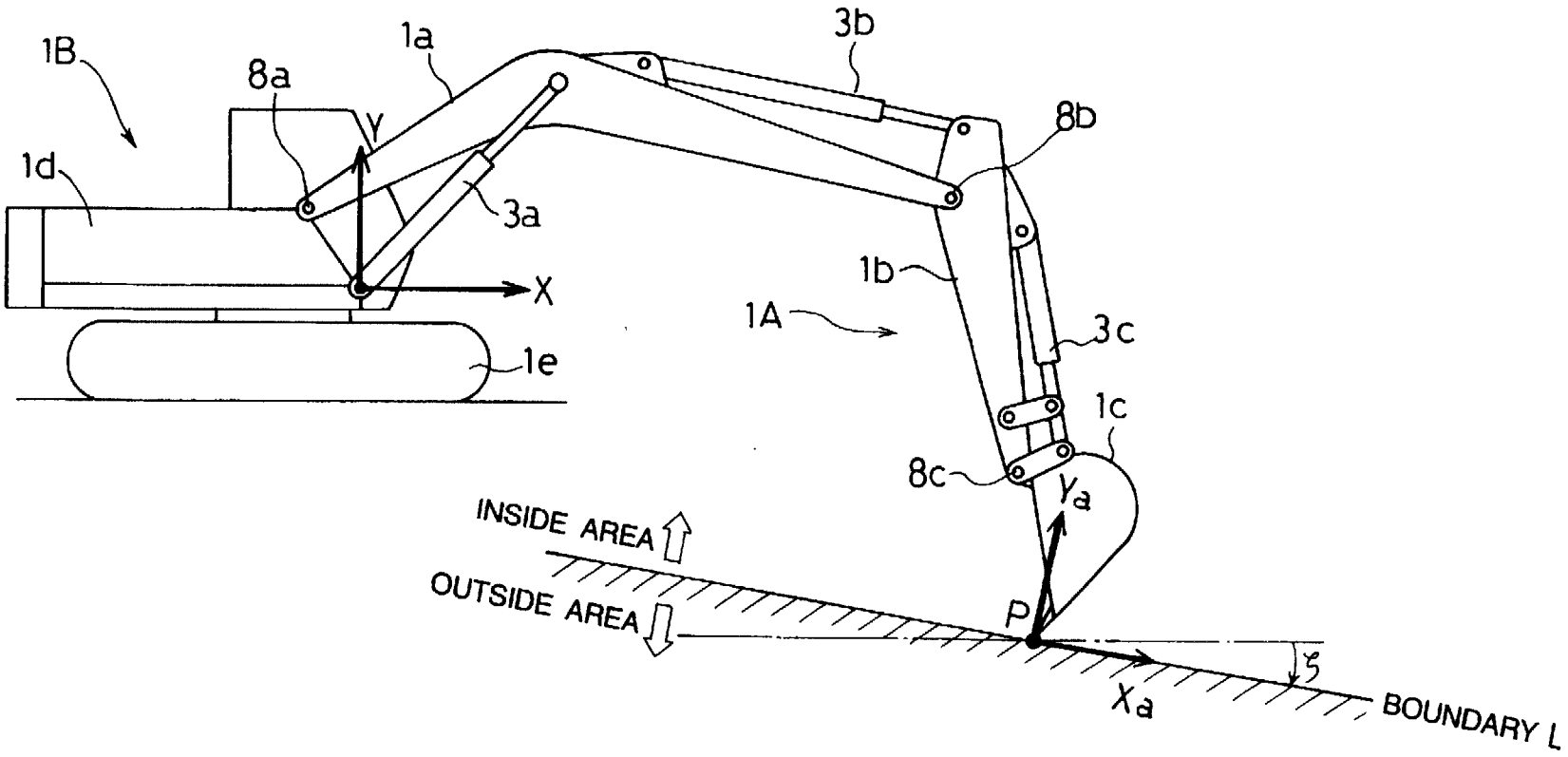
FIG. 4 is a view for explaining a manner of setting an excavation area in the area limiting excavation control of this embodiment.

In FIG. 4, after the operator has operated the front attachment to move the tip of the bucket 1c to the position of a point P, the tip position of the bucket 1c at that time is calculated in response to an instruction from the setter 7, and the boundary L of the limited excavation area is set based on an inclination angle ξ also instructed from the setter 7.

More specifically, a memory in the control unit 9 stores various dimensions of the components making up the front attachment 1A and the body 1B, and the front attachment posture calculator 9a calculates the position of the point P based on the stored data, the rotational angles detected by the angle sensors 8a, 8b, 8c and the inclination angle of the body 1b detected by the inclination angle sensor 8d. At this time, the position of the point P is determined as coordinate values on the XY-coordinate system with the origin defined as the pivotal point of the boom 1a, for example. The XY-coordinate system is an orthogonal coordinate system fixed onto the body 1B and is assumed to exist in a vertical plane.

Then, the area setting calculator 9b determines a formula expressing the straight line which corresponds to the boundary L of the limited excavation area, based on the calculated position of the point P and the inclination angle ξ instructed from the setter 7. The calculator 9b further sets an orthogonal coordinate system having the origin on the above straight line and one axis defined by the above straight line, for example, an XaYa-coordinate system with the origin defined as the point P, and then determines coordinate transform data from the XY-coordinate system into the XaYa-coordinate system.

The bucket tip speed limit value calculator 9c calculates a limit value a of the component of the bucket tip speed vertical to the boundary L based on the distance D of the bucket tip from the boundary. L. This calculation is carried out by storing the relationship, as shown in FIG. 5, in the memory of the control unit 9 beforehand and reading out the stored relationship.

Figure 5:
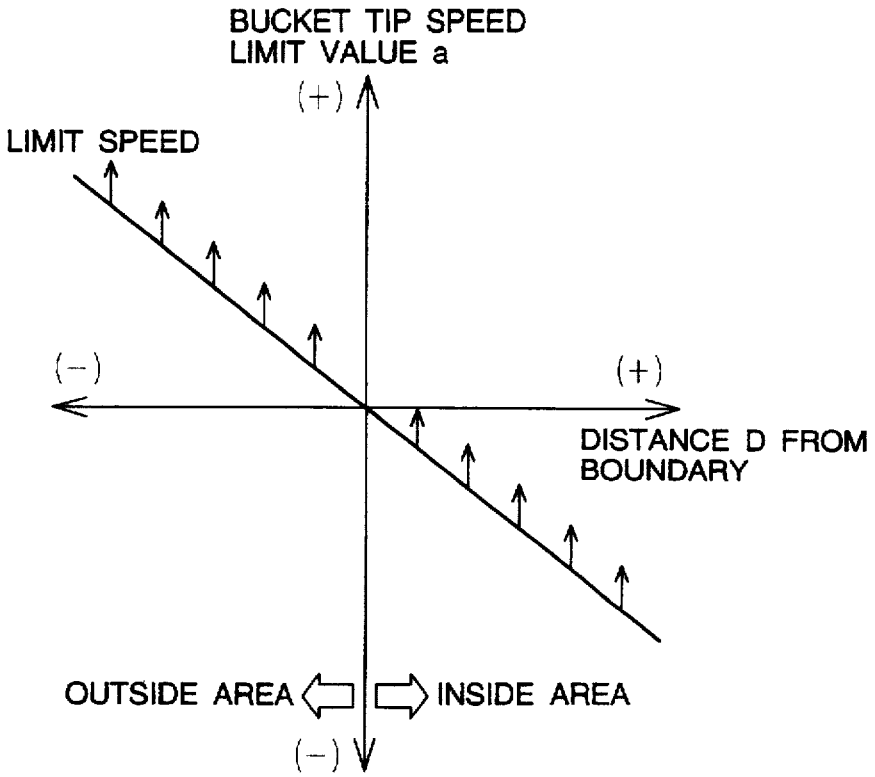
FIG. 5 is a graph showing the relationship between limit values of the speed of a bucket tip and the distance of the bucket tip from the boundary of the set area, the relationship being used to determine the limit values of the bucket tip speed.

In FIG. 5, the horizontal axis represents the distance D of the bucket tip from the boundary L, and the vertical axis represents the limit value a of the component of the bucket tip speed vertical to the boundary L. As with the XaYa-coordinate system, the distance D in the horizontal axis and the limit value a in the vertical axis are each defined to be positive (+) in the direction from the outside of the set area toward the inside of the set area. The relationship between the distance D and the limit value a is set such that when the bucket tip is inside the set area, a speed in the negative (−) direction proportional to the distance D is given as the limit value a of the component of the bucket tip speed vertical to the boundary L, and when the bucket tip is outside the set area, a speed in the positive (+) direction proportional to the distance D is given as the limit value a of the component of the bucket tip speed vertical to the boundary L. Accordingly, inside the set area, the bucket tip is sped down only when the component of the bucket tip speed vertical to the boundary L exceeds the limit value in the negative (−) direction, and outside the set area, the bucket tip is sped up in the positive (+) direction.

The arm cylinder speed calculator 9d estimates an arm cylinder speed based on the command value applied from the control lever unit 14b and the flow rate characteristics of the arm flow control valve 5b.

The arm-dependent bucket tip speed calculator 9e calculates an arm-dependent bucket tip speed b based on the arm cylinder speed and the position and posture of the front attachment 1A determined by the front attachment posture calculator 9a.

The boom-dependent bucket tip speed limit value calculator 9f transforms the arm-dependent bucket tip speed b, which has been determined by the calculator 9e, from the XY-coordinate system to the XaYa-coordinate system by using the transform data determined by the area setting calculator 9b, calculates components ($b_x$, $b_y$) of the arm-dependent bucket tip speed parallel and vertical to the boundary L, and calculates a limit value c of the boom-dependent bucket tip speed vertical to the boundary L based on the limit value a of the component of the bucket tip speed vertical to the boundary L determined by the calculator 9c and the component $b_y$ of the arm-dependent bucket tip speed vertical to the boundary L. That process will be described below with reference to FIG. 6.

Figure 6:
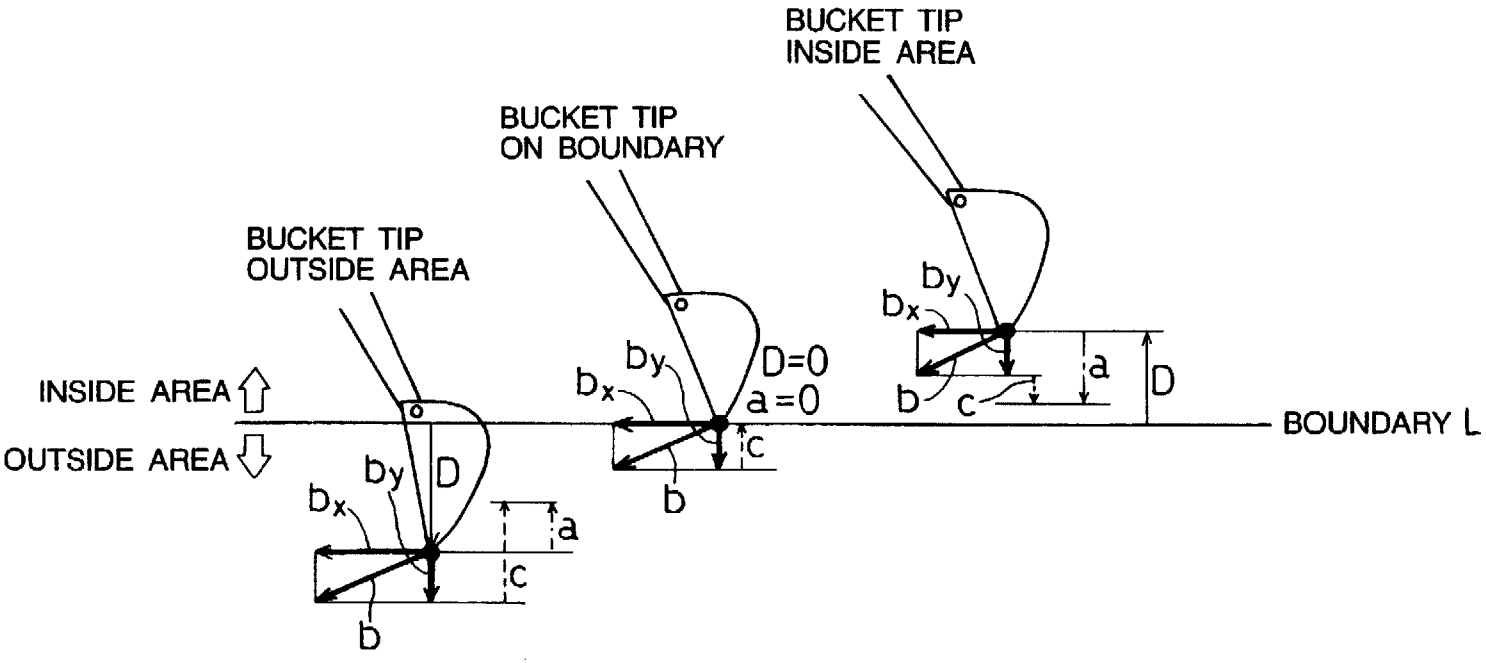
FIG. 6 is a diagram showing differences in operation for modifying the bucket tip speed with a boom between the case where the bucket tip is inside the set area, the case where it is on the boundary of the set area, and the case where it is outside the set area.

In FIG. 6, the difference ($a-b_y$) between the limit value a of the component of the bucket tip speed vertical to the boundary L determined by the bucket tip speed limit value calculator 9c and the component $b_y$ of the arm-dependent bucket tip speed b vertical to the boundary L determined by the arm-dependent bucket tip speed calculator 9e provides the limit value c of the boom-dependent bucket tip speed vertical to the boundary L. Then, the boom-dependent bucket tip speed limit value calculator 9f calculates the limit value c from the equation of $c=a-b_y$.

The meaning of the limit value c will now be described separately for the case where the bucket tip is inside the set area, the case where the bucket tip is on the boundary of the set area, and for the case where the bucket tip is outside the set area.

When the bucket tip is inside the set area, the bucket tip speed is restricted to the limit value a of the component of the bucket tip speed vertical to the boundary L in proportion to the distance D of the bucket tip from the boundary L, whereby the component of the boom-dependent bucket tip speed vertical to the boundary L is restricted to c ($=a-b_y$). If the boom-dependent bucket tip speed exceeds c, it is sped down to c.

When the bucket tip is on the boundary L of the set area, the limit value a of the component of the bucket tip speed vertical to the boundary L is set to zero (0), and the arm-dependent bucket tip speed b toward the outside of the set area is canceled through the boom-up operation for modifying the speed c so that the bucket tip speed becomes zero (0).

When the bucket tip is outside the set area, the component of the bucket tip speed vertical to the boundary L is restricted to the upward speed a in proportion to the distance D of the bucket tip from the boundary L. Thus, the boom-up operation for modifying the speed c is performed so that the bucket tip is always returned to the inside of the set area.

The boom cylinder speed limit value calculator 9g calculates a boom cylinder speed limit value through the coordinate transformation using the aforesaid transform data based on the limit value c of the boom-dependent bucket tip speed vertical to the boundary L and the position and posture of the front attachment 1A.

The boom command limit value calculator 9h determines, based on the flow rate characteristics of the boom flow control valve 15*a*, a boom command limit value corresponding to the boom cylinder speed limit value determined by the calculator 9*g*.

The boom command maximum value calculator 9*j* compares the boom command limit value determined by the calculator 9*h* with the command value from the control lever unit 14*a* and then outputs larger one of them. Here, as with the XaYa-coordinate, the command value from the control lever unit 14*a* is defined to be positive (+) when it represents the direction from the outside of the set area to the inside of the set area (i.e., the boom-up direction). Also, the function of the calculator 9*j* that it outputs larger one of the boom command limit value and the command value from the control lever unit 14*a* means that when the bucket tip is inside the set area, the calculator 9*j* outputs one having a smaller absolute value because the limit value c is negative (−), and when the bucket tip is outside the set area, it outputs one having a larger absolute value because the limit value c is negative (+).

The boom-associated valve command calculator 9*i* outputs a voltage corresponding to the command value to the boom-up driving sector 30*a* of the flow control valve 15*a* and a zero (0) voltage to the boom-down driving sector 30*b* thereof when the command value output from the boom command maximum value calculator 9*j* is positive, and outputs the respective voltages in a reversed manner to the above when the command value is negative.

The arm-associated valve command calculator 9*k* receives the command value applied from the control lever unit 14*b* and outputs a corresponding voltage to the arm-crowd driving sector 31*a* of the flow control valve 15*b* and a zero (0) voltage to the arm-dump driving sector 31*b* thereof when the command value is an arm-crowd command value, and outputs the respective voltages in a reversed manner to the above when the command value is an arm-dump command value.

In the above arrangement, the control lever units 14*a* to 14*c* constitute a plurality of input means for instructing operations of the respective front elements, i.e., the boom 1*a*, the arm 1*b*, the bucket 1*c*. The setter 7 and the area setting calculator 9*b* jointly constitute area setting means for setting an area where the front attachment 1A is movable. The angle sensors 8*a* to 8*c* and the inclination angle sensor 8*d* constitute first detecting means for detecting status variables with regard to the position and posture of the front attachment 1A. The front attachment posture calculator 9*a* constitutes first calculating means for calculating the position and posture of the front attachment 1A based on signals from the first detecting means. The arm cylinder speed calculator 9*d* and the arm-dependent bucket tip speed calculator 9*e* jointly constitute second calculating means for calculating the speed of the front attachment 1A which depends on driving of at least the arm cylinder 3*b* (first particular actuator) associated with the arm 1*b* (first particular front element) among the plurality of hydraulic actuators 3*a* to 3*f*. The bucket tip speed limit value calculator 9*c* and the boom-dependent bucket tip speed limit value calculator 9*f* jointly constitute third calculating means for calculating, based on the values calculated by the first and second calculating means, a limit value c of the speed of the front attachment 1A which depends on driving of at least the boom cylinder 3*a* (second particular actuator) associated with the boom 1*a* (second particular front element) among the plurality of hydraulic actuators 3*a* to 3*f* so that when the front attachment 1A is inside the set area near the boundary L thereof, the moving speed of the front attachment 1A in the direction toward the boundary L of the set area is restricted, and when the front attachment 1A is outside the set area, it is returned to the set area.

The boom cylinder speed limit value calculator 9*g*, the boom command limit value calculator 9*h*, the boom command maximum value calculator 9*j*, and the boom-associated valve command calculator 9*i* jointly constitute signal modifying means for modifying an operation signal from the input means 14*a* associated with the second particular actuator 3*a* so that the speed of the front attachment 1A which depends on driving of the second particular actuator 3*a* will not exceed the limit value c.

Operation of this embodiment having the above-explained arrangement will be described below. The description will be made of several examples of work; the case of operating the control lever of the boom control lever unit 14*a* in the boom-down direction to move down the boom (i.e., the boom-down operation) with an intention of positioning the bucket tip, and the case of operating the control lever of the arm control lever unit 14*b* in the arm-crowd direction to crowd the arm (i.e., the arm-crowd operation) with an intention of digging the ground toward the body.

When the control lever of the boom control lever unit 14*a* is operated in the boom-down direction with an intention of positioning the bucket tip, the command value from the control lever unit 14*a* is input to the boom command maximum value calculator 9*j*. At the same time, the calculator 9*c* calculates, based on the relationship shown in FIG. 5, a limit value a (<0) of the bucket tip speed in proportion to the distance D of the bucket tip from the boundary L of the set area, the calculator 9*f* calculates a limit value $c=a-b_y=a$ (<0) of the boom-dependent bucket tip speed, and the boom command limit value calculator 9*h* calculates a negative boom command limit value corresponding to the limit value c. Here, when the bucket tip is far from the boundary L of the set area, the command value from the control lever unit 14*a* is greater than the boom command limit value determined by the calculator 9*h* and, therefore, the boom command maximum value calculator 9*j* selects the command value from the control lever unit 14*a*. Since the selected command value is negative, the boom-associated valve command calculator 9*i* outputs a corresponding voltage to the boom-down driving sector 30*b* of the flow control valve 15*a* and a zero (0) voltage to the boom-up driving sector 30*a* so that the boom is gradually moved down in accordance with the command value from the control lever unit 14*a*.

As the boom is gradually moved down and the bucket tip comes closer to the boundary L of the set area as mentioned above, the boom-dependent bucket tip speed limit value c=a (<0) calculated by the calculator 9*f* is increased (the absolute value |a| and |c| are reduced). Then, when the corresponding boom command limit value determined by the calculator 9*h* becomes greater than the command value from the control lever unit 14*a*, the boom command maximum value calculator 9*j* selects the boom command limit value and the valve command calculator 9*i* gradually restricts the voltage output to the boom-down driving sector 30*b* of the flow control valve 15*a* depending on the limit value c. Thus, the boom-down speed is gradually restricted as the bucket tip approaches the boundary L of the set area, and the boom is stopped when the bucket tip reaches the boundary L of the set area. As a result, the bucket tip can be easily and smoothly positioned.

Because of the above modifying process being carried out in a speed control manner, if the motion of the front attachment 1A is extremely fast or the control lever unit 14*a* is abruptly operated, the bucket tip may go out beyond the boundary L of the set area due to a delay in control response, such as a delay caused in the hydraulic circuit, and the inertia of the front attachment 1A. When such an event occurs, the limit value a (=c) of the bucket tip speed in proportion to the distance D of the bucket tip from the boundary L of the set area is calculated as a positive value by the calculator 9c based on the relationship shown in FIG. 5, and the valve command calculator 9i outputs a voltage corresponding the limit value c to the boom-up driving sector 30a of the flow control valve 15a. The boom is thereby moved in the boom-up direction at a speed proportional to the distance D for moving back toward the set area and then stopped when the bucket tip returns to the boundary L of the set area. As a result, the bucket tip can be more easily positioned.

Further, when the control lever of the arm control lever unit 14b is operated in the arm-crowd direction with an intention of digging the ground toward the body, the command value from the control lever unit 14b is input to the arm-associated valve command calculator 9k which outputs a corresponding voltage to the arm-crowd driving sector 31a of the flow control valve 15b, causing the arm to be moved down toward the body. At the same time, the command value from the control lever unit 14b is input to the calculator 9d which calculates an arm cylinder speed, and then the calculator 9e calculates an arm-dependent bucket tip speed b. Also, the calculator 9c calculates, based on the relationship shown in FIG. 5, a limit value a (<0) of the bucket tip speed in proportion to the distance D of the bucket tip from the boundary L of the set area, and the calculator 9f calculates a limit value $c=a-b_y$ of the boom-dependent bucket tip speed. Here, when the bucket tip is so far from the boundary L of the set area as to meet the relationship of $a<b_y$ ($|a|>|b_y|$), the command value c is calculated as a negative value. Therefore, the boom command maximum value calculator 93 selects the command value (=0) from the control lever unit 14a, and the valve command calculator 9i outputs a zero (0) voltage to both the boom-up driving sector 30a and the boom-down driving sector 30b of the flow control valve 15a. As a result, the arm is moved toward the body in accordance with the command value from the control lever unit 14b.

Figure 7:
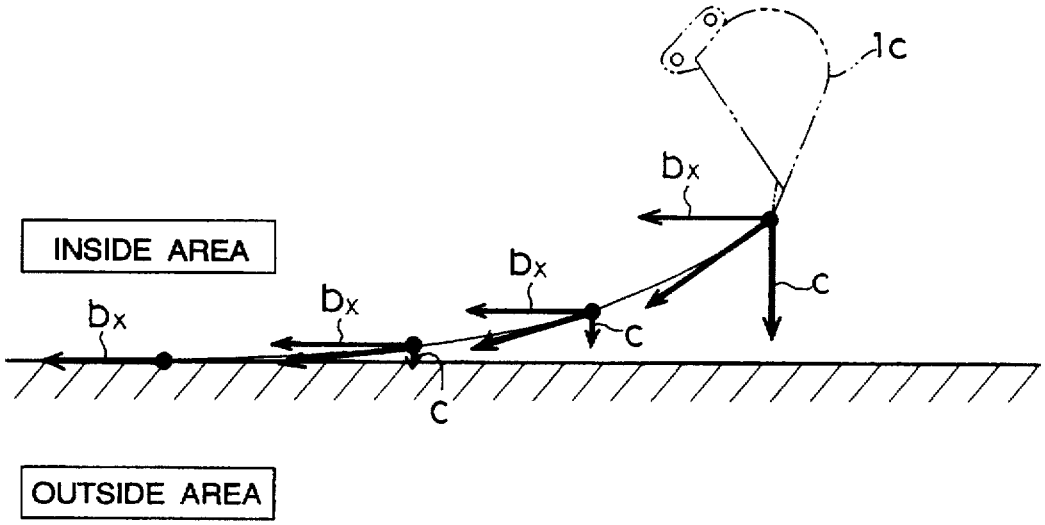
FIG. 7 is a diagram showing one example a path along which the bucket tip is moved with the modifying operation when it is inside the set area.

As the arm is gradually moved toward the body and the bucket tip comes closer to the boundary L of the set area as mentioned above, the bucket tip speed limit value a calculated by the calculator 9c is increased (the absolute value |a| is reduced). Then, when the limit value a becomes greater than the component $b_y$ of the arm-dependent bucket tip speed b vertical to the boundary L determined by the calculator 9e, the limit value $c=a-b_y$ of the boom-dependent bucket tip speed caluculated by the caluculator 9f becomes a positive value, and the boom command maximum value calculator 9j selects the limit value calculated by the calculator 9h and the valve command calculator 9i outputs a voltage corresponding to the limit value c to the boom-up driving sector 30a of the flow control valve 15a. Therefore, the boom-up operation for modifying the bucket tip speed is performed such that the component of the bucket tip speed vertical to the boundary L is gradually restricted in proportion to the distance D of the bucket tip from the boundary L. Thus, direction change control is carried out as a resultant of the unmodified component $b_x$ of the arm-dependent bucket tip speed parallel to the boundary L and the speed component vertical to the boundary L modified depending on the limit value c, as shown in FIG. 7, enabling the excavation to be performed along the boundary L of the set area.

Figure 8:
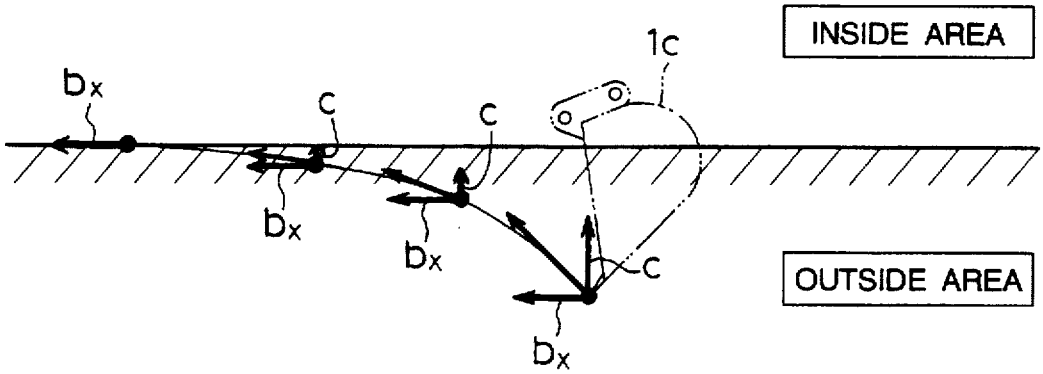
FIG. 8 is a diagram showing one example a path along which the bucket tip is moved with the modifying operation when it is outside the set area.

Also in the above case, the bucket tip may go out beyond the boundary L of the set area for the reasons stated above. When such an event occurs, the limit value a of the bucket tip speed in proportion to the distance D of the bucket tip from the boundary L of the set area is calculated as a positive value by the calculator 9c based on the relationship shown in FIG. 5, the limit value $c=a-b_y$ (>0) of the boom-dependent bucket tip speed calculated by the calculator 9f is increased in proportion to the limit value a, and the voltage output from the valve command calculator 9i to the boom-up driving sector 30a of the flow control valve 15a is increased depending on the limit value c. With the bucket tip being outside the set area, therefore, the boom-up operation for modifying the bucket tip speed is performed so that the bucket tip is moved back toward the set area at a speed proportional to the distance D. Thus, the digging is carried out under a combination of the unmodified component $b_x$ of the arm-dependent bucket tip speed parallel to the boundary L and the speed component vertical to the boundary L modified depending on the limit value c, while the bucket tip is gradually returned to and moved along the boundary L of the set area, as shown in FIG. 8. Consequently, the excavation can be smoothly performed along the boundary L of the set area just by crowding the arm.

With this embodiment explained above, when the bucket tip is inside the set area, the component of the bucket tip speed vertical to the boundary L of the set area is restricted in accordance with the limit value a in proportion to the distance D of the bucket tip from the boundary L. Accordingly, the bucket tip can be easily and smoothly positioned in the boom-down operation, and the bucket tip can be moved along the boundary of the set area in the arm-crowd operation. As a result, it is possible to smoothly and efficiently perform the excavation within a limited area.

When the bucket tip is outside the set area, the front attachment is controlled in accordance with the limit value a in proportion to the distance D of the bucket tip from the boundary L so that the bucket end is returned to the set area. Accordingly, even if the front attachment is moved fast, it can be moved along the boundary of the set area for precise excavation within a limited area.

In this connection, since the bucket tip is sped down beforehand with the direction change control as described above, the amount by which the bucket tip goes out beyond the set area is reduced and a shock which would otherwise be produced upon returning to the set area is much abated. Accordingly, even if the front attachment is moved fast, it can be smoothly moved along the boundary of the set area for smooth excavation within a limited area.

A second embodiment of the present invention will be described with reference to FIG. 9. In this embodiment, the arm cylinder speed is calculated directly through differentiation of the arm rotational angle, for example, rather than from the operation signal from the input means.

Figure 9:
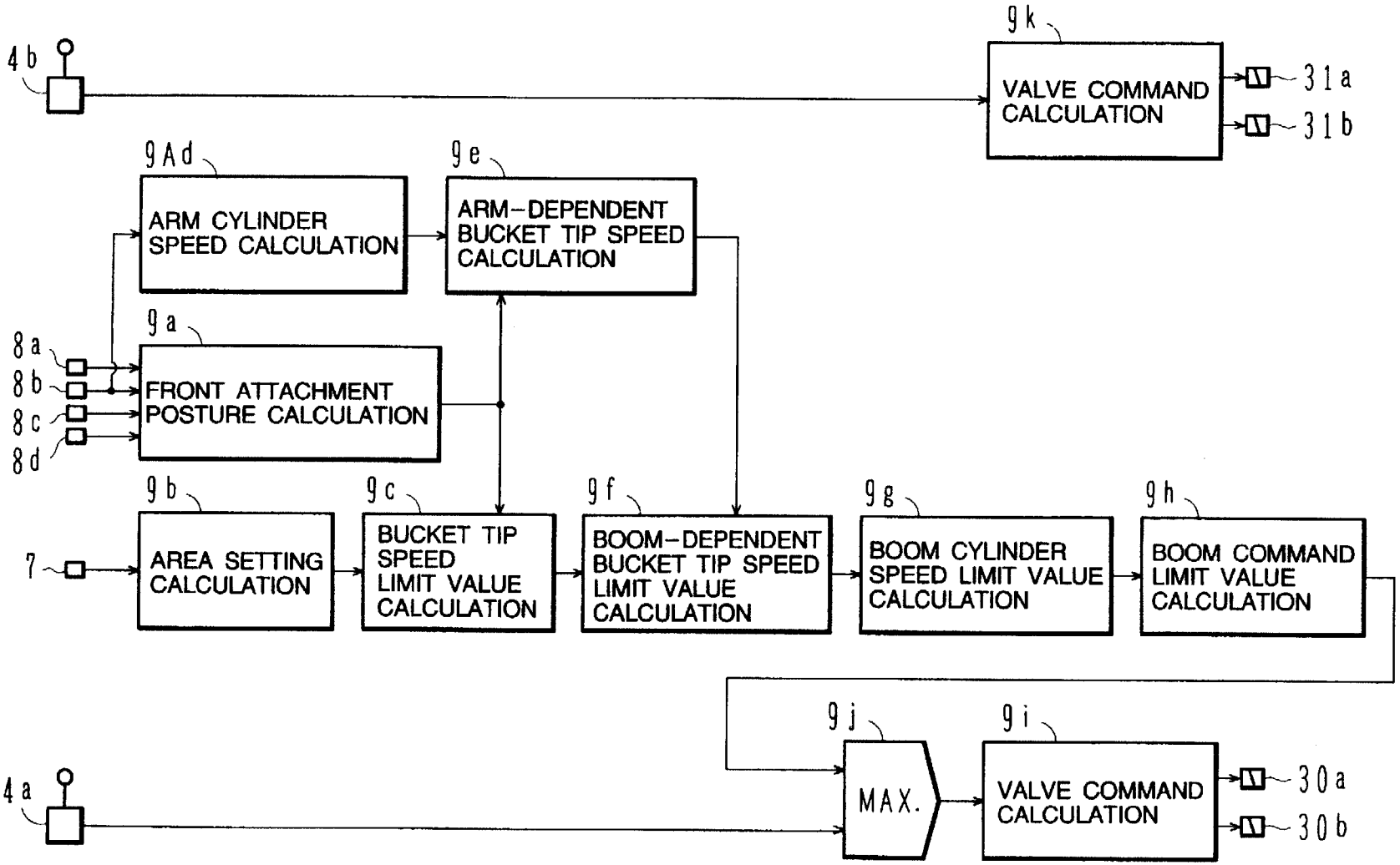
FIG. 9 is a block diagram showing control functions of a control unit in an area limiting excavation control system for a construction machine according to a second embodiment.

In FIG. 9, a control unit of this embodiment includes an arm cylinder speed calculator 9Ad which determines an arm cylinder speed directly by using the arm rotational angle detected by the angle sensor 8b instead of the command value from the control lever unit 14b, calculating an arm cylinder displacement through the coordinate transformation, and differentiating the arm cylinder displacement.

This embodiment can also provide the similar advantages as with the first embodiment.

A third embodiment of the present invention will be described with reference to FIGS. 10 and 11. In this embodiment, the invention is applied to a hydraulic excavator employing control lever units of hydraulic pilot type.

Figure 10:
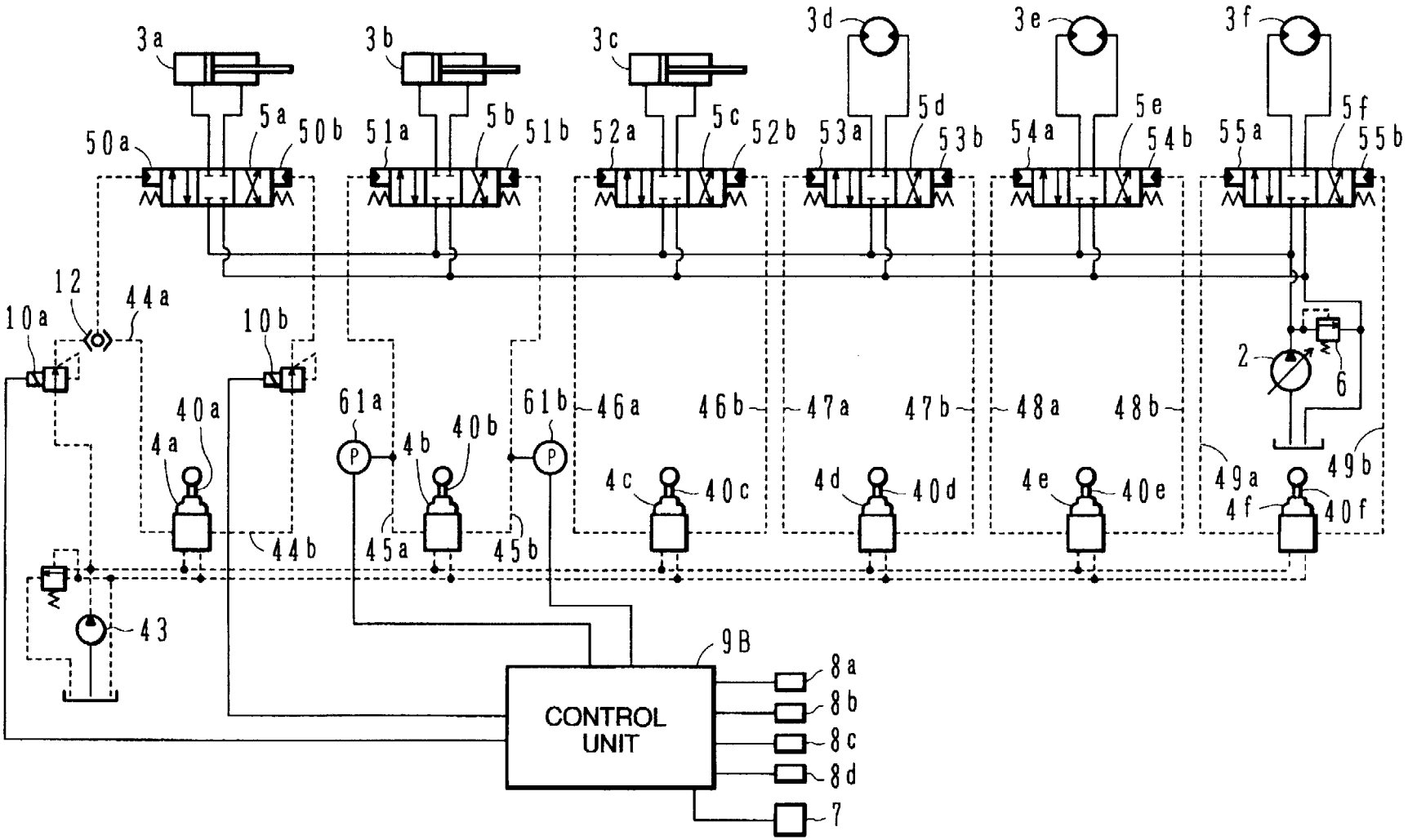
FIG. 10 is a diagram showing an area limiting excavation control system for a construction machine according to a third embodiment of the present invention, along with a hydraulic drive system.
Figure 11:
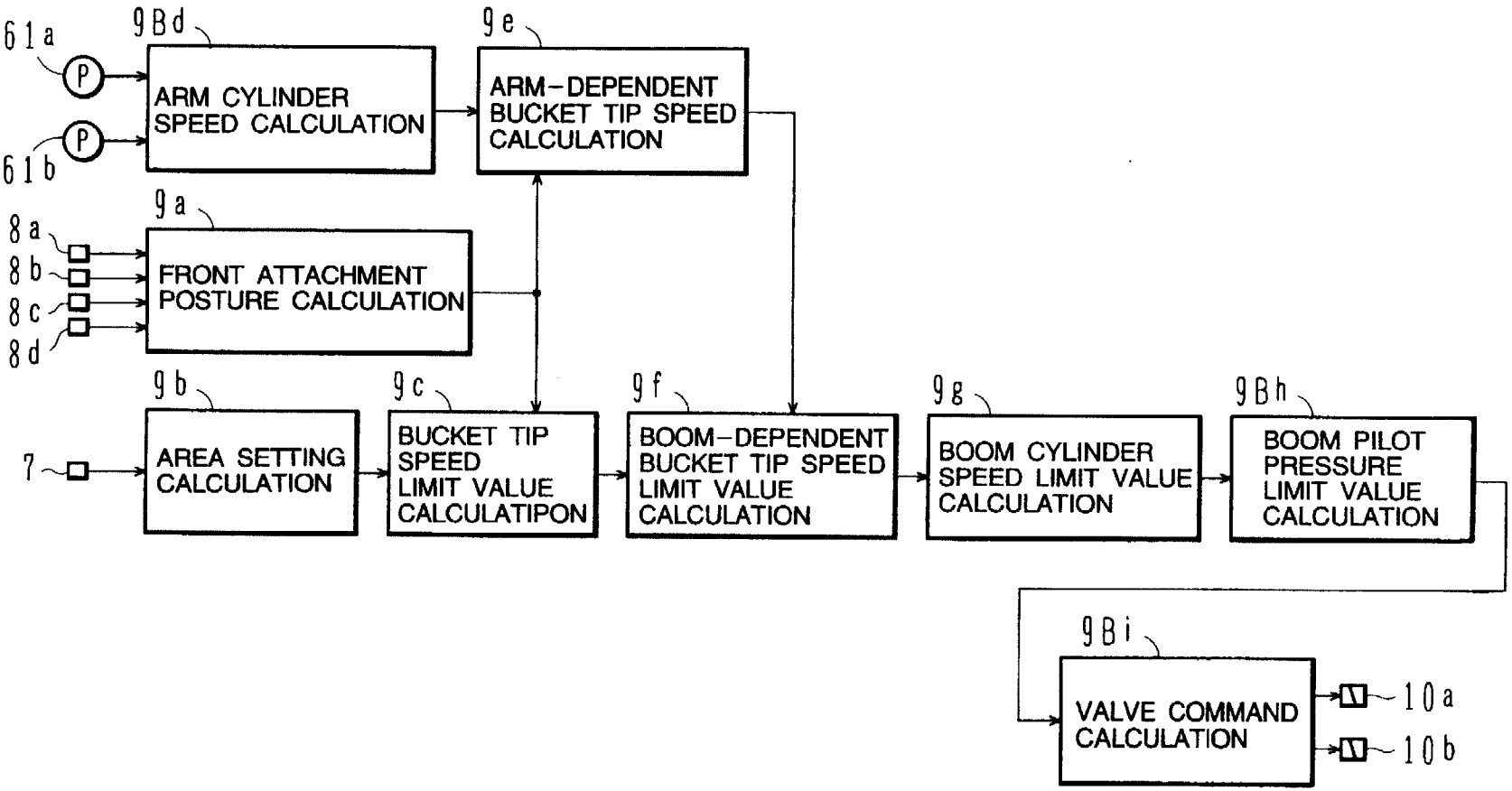
FIG. 11 is a functional block diagram showing control functions of a control unit in the third embodiment.

In FIG. 10, a hydraulic excavator to which this embodiment is applied includes control lever units 4a to 4f of hydraulic pilot type instead of the electric control lever units 14a to 14f. The control lever units 4a to 4f drive the corresponding flow control valves 5a to 5f with respective pilot pressures. Specifically, the control lever units 4a to 4f supply respective pilot pressures depending on the amounts and directions of control levers 40a to 40f, which are manipulated by the operator, to hydraulic driving sectors 50a to 55b of the corresponding flow control valves through pilot lines 44a to 49b.

An area limiting excavation control system of this embodiment is mounted on the hydraulic excavator as explained above. The control system comprises, in addition to the components used in the first embodiment, pressure sensors 61a, 61b disposed respectively in the pilot lines 45a, 45b of the arm control lever unit 4b for detecting the pilot pressures as input amounts from the control lever unit 4b, a proportional solenoid valve 10a connected at the primary port side to a pilot pump 43 for reducing and outputting the pilot pressure from the pilot pump 43 in accordance with an electric signal, a shuttle valve 12 connected to the pilot line 44a of the boom control lever unit 4a and the secondary port side of the proportional solenoid valve 10a for selecting higher one of the pilot pressure in the pilot line 44a and the control pressure output from the proportional solenoid valve 10a and then introducing the selected pressure to the hydraulic driving sector 50a of the flow control valve 5a, and a proportional solenoid valve 10b disposed in the pilot line 44b of the boom control lever unit 4a for reducing and outputting the pilot pressure in the pilot line 44b in accordance with an electric signal.

Differences in control functions of a control unit 9B in this embodiment from the control unit 9 in the first embodiment of FIG. 1 will be described with reference to FIG. 11.

An arm cylinder speed calculator 9Bd estimates an arm cylinder speed based on, instead of the command value input from the control lever unit 4b for the flow control valve 5b, the command values (pilot pressures) for the flow control valve 5b detected by the pressure sensors 61a, 61b and the flow rate characteristics of the arm flow control valve.

Also, a boom pilot pressure limit value calculator 9Bh determines, based on the flow rate characteristics of the boom flow control valve 5a, a limit value of the boom pilot pressure (command) corresponding to the boom cylinder speed limit value c determined by the calculator 9g.

Furthermore, with the provision of the proportional solenoid valves 10a, 10b and the shuttle valve 12, the boom command maximum value calculator 9j is not longer required and a valve command calculator 9Bi functions as follows. When the pilot pressure limit value determined by the boom pilot pressure limit value calculator 9Bh is positive, the calculator 9Bi outputs a voltage corresponding to the limit value to the boom-up side proportional solenoid valve 10a so that the pilot pressure supplied to the hydraulic driving sector 50a of the flow control valve 5a is restricted to the limit value, and outputs a zero (0) voltage to the boom-down side proportional solenoid valve 10b so that the pilot pressure supplied to the hydraulic driving sector 50b of the flow control valve 5a becomes zero. Conversely, when the pilot pressure limit value is negative, the calculator 9Bi outputs a voltage corresponding to the limit value to the boom-down side proportional solenoid valve 10b so that the pilot pressure supplied to the hydraulic driving sector 50b of the flow control valve 5a is restricted, and outputs a zero (0) voltage to the boom-up side proportional solenoid valve 10a so that the pilot pressure supplied to the hydraulic driving sector 50a of the flow control valve 5a becomes the same pressure in the pilot line 44a.

In the above arrangement, the control lever units 4a to 4c constitute a plurality of input means for instructing operations of the respective front elements, i.e., the boom 1a, the arm 1b, the bucket 1c. The setter 7 and the area setting calculator 9b jointly constitute area setting means for setting an area where the front attachment 1A is movable. The angle sensors 8a to 8c and the inclination angle sensor 8d constitute first detecting means for detecting status variables with regard to the position and posture of the front attachment 1A. The front attachment posture calculator 9a constitutes first calculating means for calculating the position and posture of the front attachment 1A based on signals from the first detecting means. The pressure sensors 61a, 61b, the arm cylinder speed calculator 9Bd and the arm-dependent bucket tip speed calculator 9e jointly constitute second calculating means for calculating the speed of the front attachment 1A which depends on driving of at least the arm cylinder 3b (first particular actuator) associated with the arm 1b (first particular front element) among the plurality of hydraulic actuators 3a to 3f. The bucket tip speed limit value calculator 9c and the boom-dependent bucket tip speed limit value calculator 9f jointly constitute third calculating means for calculating, based on the values calculated by the first and second calculating means, a limit value c of the speed of the front attachment 1A which depends on driving of at least the boom cylinder 3a (second particular actuator) associated with the boom 1a (second particular front element) among the plurality of hydraulic actuators 3a to 3f so that when the front attachment 1A is inside the set area near the boundary L thereof, the moving speed of the front attachment 1A in the direction toward the boundary L of the set area is restricted, and when the front attachment 1A is outside the set area, it is returned to the set area.

The boom cylinder speed limit value calculator 9g, the boom command limit value calculator 9Bh, the valve command calculator 9Bi, the proportional solenoid valves 10a, 10b and the shuttle valve 12 jointly constitute signal modifying means for modifying an operation signal from the input means 4a associated with the second particular actuator 3a so that the speed of the front attachment 1A which depends on driving of the second particular actuator 3a will not exceed the limit value c.

In addition, the control lever units 4a to 4f and the pilot lines 44a to 49b jointly constitute an operation system for driving the hydraulic control valves 5a to 5f. The above signal modifying means (the boom cylinder speed limit value Calculator 9g, the boom command limit value calculator 9Bh, the valve command calculator 9Bi, the proportional solenoid valves 10a, 10b and the shuttle valve 12) constitutes pilot pressure modifying means for modifying the pilot pressure from the input means 4a associated with the second particular actuator 3a so that the speed of the front attachment 1A which depends on driving of the second particular actuator 3a will not exceed the limit value c.

The pilot line 44a constitutes a first pilot line for introducing a pilot pressure to the hydraulic control valve 5a associated with the second particular front element 1a so that the front attachment 1A moves in the direction away from the boundary L of the set area. The boom cylinder speed limit value calculator 9g, the boom command limit value calculator 9Bh and the valve command calculator 9Bi constitute means for calculating a target pilot pressure in the first pilot line 44a so that the speed of the front attachment 1A which depends on driving of the second particular actuator 3*a* will not exceed the limit value c, and outputting a first electric signal corresponding to the target pilot pressure. The proportional solenoid valve 10*a* constitutes electro-hydraulic converting means for converting the first electric signal into a hydraulic pressure and outputting a control pressure corresponding to the target pilot pressure. The shuttle valve 12 constitutes higher pressure selecting means for selecting higher one of the pilot pressure in the first pilot line 44*a* and the control pressure output from the electro-hydraulic converting means 10*a*, and introducing the selected pressure to the corresponding hydraulic control valve 5*a*.

The pilot line 44*b* constitutes a second pilot line for introducing a pilot pressure to the hydraulic control valve 5*a* associated with the second particular front element 1*a* so that the front attachment 1A moves in the direction toward the boundary L of the set area. The boom cylinder speed limit value calculator 9*g*, the boom command limit value calculator 9Bh and the valve command calculator 9Bi constitute means for calculating a target pilot pressure in the second pilot line 44*b* so that the speed of the front attachment 1A which depends on driving of the second particular actuator 3*a* will not exceed the limit value c, and outputting a second electric signal corresponding to the target pilot pressure. The proportional solenoid valve 10*b* constitutes pressure reducing means disposed in the second pilot line 44*b* and operated by the second electric signal for reducing the pilot pressure in the second pilot line 44*b* down to the target pilot pressure.

Operation of this embodiment having the above-explained arrangement will be described below in connection with the boom-down operation and the arm-crowd operation as with the first embodiment.

When the control lever of the boom control lever unit 4*a* is operated in the boom-down direction with an intention of positioning the bucket tip, a pilot pressure as the command value from the control lever unit 4*a* is applied to the boom-down side hydraulic driving sector 50*b* of the flow control valve 5*a* through the pilot line 44*b*. At the same time, the calculator 9*c* calculates, based on the relationship shown in FIG. 5, a limit value a (<0) of the bucket tip speed in proportion to the distance D of the bucket tip from the boundary L of the set area, the calculator 9*f* calculates a limit value $c=a-b_y=a$ (<0) of the boom-dependent bucket tip speed, and the boom pilot pressure limit value calculator 9Bh calculates a negative boom command limit value corresponding to the limit value c. Therefore, the valve command calculator 9Bi outputs a voltage corresponding to the limit value to the proportional solenoid valve 10*b* so that the pilot pressure supplied to the boom-down side hydraulic driving sector 50*b* of the flow control valve 5*a* is restricted, and a zero (0) voltage to the proportional solenoid valve 10*a* so that the pilot pressure supplied to the boom-up side hydraulic driving sector 50*a* of the flow control valve 5*a* becomes zero. Here, when the bucket tip is far from the boundary L of the set area, the limit value of the boom pilot pressure determined by the calculator 9Bh has a greater absolute value than the pilot pressure from the control lever unit 4*a* and, therefore, the proportional solenoid valve 10*b* outputs the pilot pressure from the control lever unit 4*a* as it is. As a result, the boom is gradually moved down in accordance with the pilot pressure from the control lever unit 4*a*.

As the boom is gradually moved down and the bucket tip comes closer to the boundary L of the set area as mentioned above, the boom-dependent bucket tip speed limit value c=a (<0) calculated by the calculator 9*f* is increased (the absolute value |a| and |c| are reduced) and an absolute value of the corresponding boom command limit value (<0) determined by the calculator 9Bh is also reduced. Then, when the absolute value of the limit value becomes smaller than the command value from the control lever unit 4*a* and the voltage output from the valve command calculator 9Bi to the proportional solenoid valve 10*b* also becomes smaller correspondingly, the proportional solenoid valve 10*b* reduces and outputs the pilot pressure from the control lever unit 4*a* to gradually restrict the pilot pressure supplied to the boom-down driving sector 50*b* of the flow control valve 5*a* depending on the limit value c. Thus, the boom-down speed is gradually restricted as the bucket tip approaches the boundary L of the set area, and the boom is stopped when the bucket tip reaches the boundary L of the set area. As a result, the bucket tip can be easily and smoothly positioned.

When the bucket tip goes out beyond the boundary L of the set area, the limit value a (=c) of the bucket tip speed in proportion to the distance D of the bucket tip from the boundary L of the set area is calculated as a positive value by the calculator 9*c* based on the relationship shown in FIG. 5, and the valve command calculator 9Bi outputs a voltage corresponding to the limit value a to the proportional solenoid valve 10*a* for applying a pilot pressure corresponding to the limit value a to the boom-up side hydraulic driving sector 50*a* of the flow control valve 5*a*. The boom is thereby moved in the boom-up direction at a speed proportional to the distance D for moving back toward the set area, and then stopped when the bucket tip returns to the boundary L of the set area. As a result, the bucket tip can be more easily positioned.

Further, when the control lever of the arm control lever unit 4*b* is operated in the arm-crowd direction with an intention of digging the ground toward the body, a pilot pressure as the command value from the control lever unit 4*b* is applied to the arm-crowd side hydraulic driving sector 51*a* of the flow control valve 5*b*, causing the arm to be moved down toward the body. At the same time, the pilot pressure from the control lever unit 4*b* is detected by the pressure sensor 61*a* and input to the calculator 9Bd which calculates an arm cylinder speed, and then the calculator 9*e* calculates an arm-dependent bucket tip speed b. Also, the calculator 9*c* calculates, based on the relationship shown in FIG. 5, a limit value a (<0) of the bucket tip speed in proportion to the distance D of the bucket tip from the boundary L of the set area, and the calculator 9*f* calculates a limit value $c=a-b_y$ of the boom-dependent bucket tip speed. Here, when the bucket tip is so far from the boundary L of the set area as to meet the relationship of $a<b_y$ ($|a|>|b_y|$), the command value c is calculated as a negative value. Therefore, the valve command calculator 9Bi outputs a voltage corresponding to the limit value to the proportional solenoid valve 10*b* for restricting the pilot pressure supplied to the boom-down side hydraulic driving sector 50*b* of the flow control value 5*a*, and a zero (0) voltage to the proportional solenoid valve 10*a* for making zero the pilot pressure supplied to the boom-up side hydraulic driving sector 50*a* of the flow control valve 5*a*. At this time, since the control lever unit 4*a* is not operated, no pilot pressure is supplied to the hydraulic driving sector 50*b* of the flow control valve 5*a*. As a result, the arm is gradually moved toward the body depending on the pilot pressure from the control lever unit 4*b*.

As the arm is gradually moved toward the body and the bucket tip comes closer to the boundary L of the set area as mentioned above, the bucket tip speed limit value a calculated by the calculator 9*c* is increased (the absolute value |a| is reduced). Then, when the limit value a becomes greater than the component $b_y$ of the arm-dependent bucket tip speed b vertical to the boundary L determined by the calculator 9e, the limit value $c=a-b_y$ of the boom-dependent bucket tip speed is calculated as a positive value by the calculator 9f, and the valve command calculator 9Bi outputs a voltage corresponding to the limit value c to the proportional solenoid valve 10a for restricting the pilot pressure supplied to the boom-up side hydraulic driving sector 50a of the flow control valve 5a to the limit value c, and outputs a zero (0) voltage to the proportional solenoid valve 10b for making zero the pilot pressure supplied to the boom-down side hydraulic driving sector 50b of the flow control valve 5a. Therefore, the boom-up operation for modifying the bucket tip speed is performed such that the component of the bucket tip speed vertical to the boundary L is gradually restricted in proportion to the distance D of the bucket tip from the boundary L. Thus, direction change control is carried out as a resultant of the unmodified component $b_x$ of the arm-dependent bucket tip speed parallel to the boundary L and the speed component vertical to the boundary L modified depending on the limit value c, as shown in FIG. 7, enabling the excavation to be performed along the boundary L of the set area.

Further, when the bucket tip may go out beyond the boundary L of the set area, the limit value a of the bucket tip speed in proportion to the distance D of the bucket tip from the boundary L of the set area is calculated as a positive value by the calculator 9c based on the relationship shown in FIG. 5, the limit value $c=a-b_y$ (>0) of the boom-dependent bucket tip speed calculated by the calculator 9f is increased in proportion to the limit value a, and the voltage output from the valve command calculator 9Bi to the proportional solenoid valve 10a on the boom-up side is increased depending on the limit value c. With the bucket tip being outside the set area, therefore, the boom-up operation for modifying the bucket tip speed is performed so that the bucket tip is moved back toward the set area at a speed proportional to the distance D. Thus, the digging is carried out under a combination of the unmodified component $b_x$ of the arm-dependent bucket tip speed parallel to the boundary L and the speed component vertical to the boundary L modified depending on the limit value c, while the bucket tip is gradually returned to and moved along the boundary L of the set area, as shown in FIG. 8. Consequently, the excavation can be smoothly performed along the boundary L of the set area just by crowding the arm.

With this embodiment explained above, the similar advantages as with the first embodiment can be provided in the system employing the input means of hydraulic control type.

The foregoing embodiments have been described as employing the distance D from the bucket tip to the boundary L of the set area. From the viewpoint of implementing the invention in a simpler way, however, the distance from a pin at the arm tip to the boundary L may be employed instead. Further, when the excavation area is set for the purpose of preventing interference of the front attachment and ensuring safety, the distance may be set with regard to any other suitable location where the interference would occur.

While the hydraulic drive system to which the present invention is applied has been described as a closed center system including the flow control valves 15a–15f; 5a–5f of closed center type, the present invention is also applicable to an open center system including flow control valves of open center type.

The relationship between the distance from the bucket tip to the boundary L of the set area and the limit value a of the bucket tip speed has been described as being linearly proportional to each other, but is not restricted to such a relationship and may be set in various ways.

The foregoing embodiments are arranged such that when the bucket tip is away from the boundary of the set area, the target speed vector is output as it is. Even in such a condition, however, the target speed vector may also be modified for any other purpose.

While the vector component of the target speed vector in the direction toward the boundary of the set area has been described as being vertical to the boundary of the set area, it may be deviated from the vertical direction so long as the bucket tip can be moved in the direction along the boundary of the set area.

In third embodiment wherein the present invention is applied to a hydraulic excavator having control lever units of hydraulic pilot type, the proportional solenoid valves 10a, 10b are employed as the electro-hydraulic converting means and the pressure reducing means. But the proportional solenoid valves may be replaced by any other suitable electro-hydraulic converting means.

Further, while the control lever units 4a to 4f and the flow control valves 5a to 5f have all been described as being of hydraulic pilot type, it is only required that the control lever units and the flow control valves for at least the boom and the arm are of hydraulic pilot type.

According to the present invention, as described above, since the direction change control is performed in such a manner as to speed down the bucket tip in the direction toward the boundary of the set area as the front attachment approaches the set area, the excavation can be smoothly and efficiently carried out within a limited area.

What is claimed is:

1. An area limiting excavation control system for a construction machine comprising:

a multi-articulated front device constituted by a plurality of front elements coupled to each other in a relatively rotatable manner;

a plurality of hydraulic actuators for driving said plurality of front elements;

a plurality of input means for instructing motions of said plurality of front elements; and a plurality of hydraulic control valves driven upon operation of said plurality of input means for controlling respective flow rates of a hydraulic fluid supplied to said plurality of hydraulic actuators, wherein said control system further comprises:

area setting means for setting an area to be excavated by said front device;

first detecting means for detecting status variables with regard to the position and posture of said front device;

first calculating means for calculating the position and posture of said front device based on signals from said first detecting means;

second calculating means for calculating the speed of said front device by driving at least a first particular actuator associated with a first particular front element among said plurality of hydraulic actuators;

third calculating means for calculating, based on the values calculated by said first and second calculating means, a limit value of the speed of said front device by driving at least a second particular actuator associated with a second particular front element among said plurality of hydraulic actuators so that when said front device is inside said set area to be excavated near the boundary thereof, the moving speed of said front device in the direction toward the boundary of said set area to be excavated is restricted and when said front device is operated to move beyond the boundary of said set area to be excavated, said front device is allowed to move in the direction along the boundary of said set area to be excavated; and signal modifying means for modifying an operation signal from said input means associated with said second particular actuator so that the speed of said front device by driving of said second particular actuator will not exceed said limit value.

2. An area limiting excavation control system for a construction machine according to claim 1, wherein said second calculating means is means for calculating the speed of said front device by driving of said first particular actuator, based on an operation signal from said input means associated with said first particular front element among said plurality of input means.

3. An area limiting excavation control system for a construction machine according to claim 1, wherein said second calculating means is means for calculating the speed of said front device by driving of said first particular actuator, based on a signal from said first detecting means.

4. An area limiting excavation control system for a construction machine according to claim 2, wherein said third calculating means calculates a limit value of the speed of said front device by driving of at least said second particular actuator associated with said second particular front element among said plurality of hydraulic actuators so that when said front attachment is outside said set area to be excavated, it is returned to said set area.

5. An area limiting excavation control system for a construction machine according to claim 4, wherein said third calculating means includes:

means for calculating a limit value of the speed of said front device based on the distance between said front device and the boundary of said set area to be excavated, said distance being determined from the values calculated by said first calculating means; and means for calculating a limit value of the speed of said front device by driving of said second particular actuator, based on the value calculated by said second calculating means and said limit value of the speed of said front device.

6. An area limiting excavating control system for a construction machine according to claim 5, wherein a distance versus speed relationship is preset such that when said front device is inside said set area to be excavated, said limit value is given as a speed in the direction approaching the boundary of said set area to be excavated which speed is reduced as the distance between said front device and the boundary of said set area to be excavated reduces, and when said front device is outside said set area to be excavated, said limit value is given as a speed in the direction returning to the boundary of said set area to be excavated which speed is increased as said distance increases, and wherein said means for calculating a limit value of the speed of said front device calculates the limit value of the speed of said front device based on the distance between said front device and the boundary of said set area to be excavated, said distance being determined from the values calculated by said first calculating means, and said present relationship.

7. An area limiting excavation control system for a construction machine according to claim 5, wherein said signal modifying means includes:

means for calculating a limit value of the operation signal of said input means associated with said second particular front element, corresponding to the limit value of the speed of said front device by driving of said second particular actuator; and means for selecting smaller one of a command value of the operation signal from said input means associated with said second particular front element and said limit value of the operation signal.

8. An area limiting excavation control system for a construction machine according to claim 5, wherein at least the input means associated with said second particular front element among said plurality of input means is of hydraulic pilot type outputting a pilot pressure as the operation signal, an operation system including said input means of hydraulic pilot type drives corresponding one of said hydraulic control valves, and said signal modifying means is pilot pressure modifying means for modifying the pilot pressure from said input means associated with said second particular actuator so that the speed of said front device by driving of said second particular actuator will not exceed said limit value.

9. An area limiting excavation control system for a construction machine according to claim 8, wherein said operation system includes a first pilot line for introducing a pilot pressure to the hydraulic control valve associated with said second particular front element so that said front device moves in the direction away from the boundary of said set area to be excavated, and wherein said pilot pressure modifying means comprises means for calculating a target pilot pressure in said first pilot line so that the speed of said front device by driving of said second particular actuator will not exceed said limit value, and outputting a first electric signal corresponding to said target pilot pressure;

electro-hydraulic converting means for converting said first electric signal into a hydraulic pressure and outputting a control pressure corresponding to said target pilot pressure; and higher pressure selecting means for selecting higher one of the pilot pressure in said first pilot line and the control pressure output from said electro-hydraulic converting means, and introducing the selected pressure to the corresponding hydraulic control valve.

10. An area limiting excavation control system for a construction machine according to claim 8, wherein said operation system includes a second pilot line for introducing a pilot pressure to the hydraulic control valve associated with said second particular front element so that said front device moves in the direction toward the boundary of said set area to be excavated, and wherein said pilot pressure modifying means comprises means for calculating a target pilor pressure in said second pilot line so that the speed of said front device by driving of said second particular actuator will not exceed said limit value, and outputting a second electric signal corresponding to said target pilot pressure; and pressure reducing means disposed in said second pilot line and operated by said second electric signal for reducing the pilot pressure in said second pilot line down to said target pilot pressure.

11. An area limiting excavation control system for a construction machine comprising:

a multi-articulated front device constituted by a plurality of front elements including a boom and an arm coupled to a tip end side of said boom in a relatively rotatable manner;

a plurality of hydraulic actuators, including a boom actuator and an arm actuator, for driving said plurality of front elements;

a plurality of input means, including boom-associated input means and arm-associated input means, for instructing motions of said plurality of front elements; and a plurality of hydraulic control valves, including a boom-associated hydraulic control valve and an arm-associated hydraulic control valve, driven upon operation of said plurality of input means for controlling respective flow rates of a hydraulic fluid supplied to said plurality of hydraulic actuators, wherein said control system further comprises:

area setting means for setting an area to be excavated by said front device;

first detecting means for detecting status variables with regard to the position and posture of said front device;

first calculating means for calculating the position and posture of said front device based on signals from said first detecting means;

second calculating means for calculating the speed of said front device by driving of at least said arm actuator among said plurality of hydraulic actuators;

third calculating means for calculating, based on the values calculated by said first and second calculating means, a limit value of the speed of said front device by driving of at least said boom actuator among said plurality of hydraulic actuators so that when said front device is inside said set area to be excavated near the boundary thereof, the moving speed of said front device in the direction toward the boundary of said set area to be excavated is restricted and when said front device is operated to move beyond the boundary of said set area to be excavated, said front device is allowed to move in the direction along the boundary of said set area to be excavated; and signal modifying means for modifying an operation signal from said boom-associated input means so that the speed of said front device by driving of said boom actuator will not exceed said limit value.

12. An area limiting excavation control system for a construction machine according to claim 11, wherein said second calculating means is means for calculating the speed of said front device by driving of said arm actuator, based on an operation signal from said arm-associated input means.

13. An area limiting excavation control system for a construction machine according to claim 11, wherein said second calculating means is means for calculating the speed of said front device by driving of said arm actuator, based on a signal from said first detecting means.

14. An area limiting excavation control system for a construction machine according to claim 12, wherein said third calculating means calculates a limit value of the speed of said front device by driving of said boom actuator so that when said front attachment is outside said set area to be excavated, it is returned to the set area.

15. An area limiting excavation control system for a construction machine according to claim 14, wherein said third calculating means includes:

means for calculating a limit value of the speed of said front device based on the distance between said front device and the boundary of said set area to be excavated, said distance being determined from the values calculated by said first calculating means; and means for calculating a limit value of the speed of said front device by driving of said boom actuator, based on the value calculated by said second calculating means and said limit value of the speed of said front device.

16. An area limiting excavation control system for a construction machine according to claim 15, wherein a distance versus speed relationship is preset such that when said front device is inside said set area to be excavated, said limit value is given as a speed in the direction approaching the boundary of said set area to be excavated which speed is reduced as the distance between said front device and the boundary of said set area to be excavated which speed is reduced as the distance between said front device and the boundary of said set area to be excavated reduces, and when said front device is outside said set area to be excavated, said limit value is given as a speed in the direction returning to the boundary of said set area to be excavated which speed is increased as said distance increases, and wherein said means for calculating a limit value of the speed of said front device calculates the limit value of the speed of said front device based on the distance between said front device and the boundary of said set area to be excavated, said distance being determined from the values calculated by said first calculating means, and said preset relationship.

17. An area limiting excavation control system for a construction machine according to claim 15, wherein said signal modifying means includes:

means for calculating a limit value of the operation signal of said boom-associated input means corresponding to the limit value of the speed of said front device by driving of said boom actuator; and means for selecting a smaller one of a command value of the operation signal from said boom-associated input means and said limit value of the operation signal.

18. An area limiting excavation control system for a construction machine according to claim 15, wherein said boom-associated input means is of hydraulic pilot type outputting a pilot pressure as the operation signal, an operation system including said input means of hydraulic pilot type drives corresponding one of said hydraulic control valves, and said signal modifying means is pilot pressure modifying means for modifying the pilot pressure from said boom-associated input means so that the speed of said front device by driving of said boom actuator will not exceed said limit value.

19. An area limiting excavation control system for a construction machine according to claim 18, wherein said operation system includes a first pilot line for introducing a pilot pressure to said boom-associated hydraulic control valve so that said front device moves in the direction away from the boundary of said set area to be restricted, and wherein said pilot pressure modifying means comprises means for calculating a target pilot pressure in said first pilot line so that the speed of said front device by driving of said boom actuator will not exceed said limit value, and outputting a first electric signal corresponding to said first target pilot pressure;

electro-hydraulic converting means for converting said first electric signal into a hydraulic pressure and outputting a control pressure corresponding to said first target pilot pressure; and higher pressure selecting means for selecting a higher one of the pilot pressure in said first pilot line and the control pressure output from said electro-hydraulic converting means, and introducing the selected pressure to the corresponding hydraulic control valve.

20. An area limiting excavation control system for a construction machine according to claim 18, wherein said operation system includes a second pilot line for introducing a pilot pressure to said boom-associated hydraulic control valve so that said front device moves in the direction toward the boundary of said set area to be excavated, and wherein said pilot pressure modifying means comprises means for calculating a second target pilot pressure in said second pilot line so that the speed of said front device by driving of said boom actuator will not exceed said limit value, and outputting a second electric signal corresponding to said second target pilot pressure; and pressure reducing means disposed in said second pilot line and operated by said second electric signal for reducing the pilot pressure in said second pilot line down to said second target pilot pressure.

21. An area limiting excavation control system for a construction machine according to claim 1, wherein said control system further comprises:

signal handling means for handling an operation signal from said input means associated with said first particular actuator to drive the corresponding hydraulic control valve such that said first particular front element is operated at a speed dependent upon the operation signal from the input means associated with the first particular actuator even when said front device approaches and reaches the boundary of said set area to be excavated.

22. An area limiting excavation control system for a construction machine according to claim 11, wherein said control system further comprises:

signal handling means for handling an operation signal from said arm-associated input means to drive the arm-associated hydraulic control valve such that said arm is operated at a speed dependent upon the operation signal from the arm-associated input means even when said front device approaches and reaches the boundary of said area to be excavated.

23. An area limiting excavation control system for a construction machine comprising:

a multi-articulated front device constituted by a plurality of front elements coupled to each other in a relatively rotatable manner;

a plurality of hydraulic actuators for driving said plurality of front elements;

a plurality of input means for instructing motions of said plurality of front elements;

and a plurality of hydraulic control valves driven upon operation of said plurality of input means for controlling respective flow rates of a hydraulic fluid supplied to said plurality of hydraulic actuators, wherein said control system further comprises:

area setting means for setting an area to be excavated by said front device;

first detecting means for detecting status variables with regard to the position and posture of said front device;

first calculating means for calculating the position and posture of said front device based on signals from said first detecting means;

second calculating means for calculating the speed of said front device by driving of at least a first particular actuator associated with a first particular front element among said plurality of hydraulic actuators;

third calculating means for calculating, based on the values calculated by said first and second calculating means, a limit value of the speed of said front device by driving of at least a second particular actuator associated with a second particular front element among said plurality of hydraulic actuators so that when said front device is inside said set area to be excavated near the boundary thereof, the moving speed of said front device in the direction toward the boundary of said set area to be excavated is restricted;

signal handling means for handling an operation signal from said input means associated with said first particular actuator to drive the corresponding hydraulic control valve such that said first particular front element is operated at a speed dependent upon the operation signal from the input means associated with the first particular actuator even when said front device approaches and reaches the boundary of said set area to be excavated; and signal modifying means for modifying an operation signal from said input means associated with said second particular actuator so that the speed of said front device by driving of said second particular actuator will not exceed said limit value.

24. An area limiting excavation control system for a construction machine comprising:

a multi-articulated front device constituted by a plurality of front elements including a boom and an arm coupled to the tip side of said boom in a relatively rotatable manner;

a plurality of hydraulic actuators, including a boom actuator and an arm actuator, for driving said plurality of front elements; a plurality of input means, including boom-associated input means and arm-associated input means, for instructing motions of said plurality of front elements; and a plurality of hydraulic control valves, including a boom-associated hydraulic control valve and an arm-associated hydraulic control valve, driven upon operation of said plurality of input means for controlling respective flow rates of a hydraulic fluid supplied to said plurality of hydraulic actuators, wherein said control system further comprises:

area setting means for setting an area to be excavated by said front device;

first detecting means for detecting status variables with regard to the position and posture of said front device;

first calculating means for calculating the position and posture of said front device based on signals from said first detecting means;

second calculating means for calculating the speed of said front device by driving of at least said arm actuator among said plurality of hydraulic actuators;

third calculating means for calculating, based on the values calculated by said first and second calculating means, a limit value of the speed of said front device by driving of at least said boom actuator among said plurality of hydraulic actuators so that when said front device is inside said set area to be excavated near the boundary thereof, the moving speed of said front device in the direction toward the boundary of said set area to be evacuated is restricted.

* * * * *